United States Patent [19]

Harrison et al.

[11] 4,301,876

[45] Nov. 24, 1981

[54] NON-ROTATING STABILIZER FOR RAISE BORING

[75] Inventors: Simon J. Harrison, Azilda; Enea R. Pividor, Sudbury, both of Canada

[73] Assignee: Smith International, Inc., Newport Beach, Calif.

[21] Appl. No.: 69,352

[22] Filed: Aug. 24, 1979

[51] Int. Cl.[3] ..... E21D 3/00

[52] U.S. Cl. ..... 175/53; 175/325; 175/344

[58] Field of Search ..... 175/53, 325, 62, 344, 175/391, 392, 376; 308/4 A

[56] References Cited

U.S. PATENT DOCUMENTS

| | | | |
|---|---|---|---|
| 2,675,213 | 4/1954 | Poole et al. | 175/62 X |
| 3,063,759 | 11/1962 | Moore | 308/4 A |
| 3,486,572 | 12/1969 | Hamilton et al. | 175/53 |
| 3,659,660 | 5/1972 | Conn | 175/53 |
| 3,797,592 | 3/1974 | Goodfellow | 175/53 X |
| 3,858,667 | 1/1975 | Goodfellow | 175/53 |
| 4,010,808 | 3/1977 | Youngblood | 175/391 |
| 4,098,544 | 7/1978 | Still et al. | 308/4 A |
| 4,179,001 | 12/1979 | Still et al. | 175/325 X |

*Primary Examiner*—James A. Leppink

*Attorney, Agent, or Firm*—Knobbe, Martens

[57] ABSTRACT

A non-rotating stabilizer for raise boring having a diameter substantially equal to the raise head and which is positioned below the raise head so as to follow it as the hole is bored is disclosed. A second raise head having a larger diameter than the stabilizer may be positioned below the stabilizer.

6 Claims, 4 Drawing Figures

NON-ROTATING STABILIZER FOR RAISE BORING

BACKGROUND OF THE INVENTION

The invention generally relates to large diameter hole drill bit assemblies and specifically to raise boring drill bit assemblies.

Large diameter holes can be bored between a first and second levels by a drilling operation referred to as raise drilling. Typically in a raise drilling operation, a pilot hole is drilled through the earth from the first location to the second location using a small diameter pilot bit. After the pilot hole is drilled, the pilot bit is removed and a large diameter raise boring head introduced at the lower level through a separate access is attached to the drill string. The raise boring head is then rotated and drawn up through the pilot hole thereby enlarging the pilot hole to desired size. As described in U.S. Pat. No. 3,659,660, to William N. Conn, the raise bit drilling assembly can include a plurality of cutter stages of increasing diameter positioned so that the larger diameter drilling stages following those of smaller diameter as the assembly is pulled upward.

As the raise drill assembly is boring through the formation, it is subjected to lateral forces which can result in an unstabilized and inefficient drilling operation. These lateral forces can cause deflection of the raise head and drill string which can lead to failure of the drill string which can lead to failure of the drill string or detachment of the head. This can occur, for example, when the material of the earth which is being cut is much harder on one side of the drill head than the other. These stabilization problems are aggravated and additional problems introduced when the pilot hole extends at an angle. In this situation, the large diameter raise head is subjected to new forces and to greater existing forces. For example, the weight of the bit can cause it to drift to the low side of the hole and the row of cutters can dig into the bottom side of the hole. This causes excessive wear on the cutting structure and possible fatigue failure of the drill string. For these reasons, large diameter holes of greater than about 84 inches in diameter have previously been restricted to vertical or near vertical holes.

In order to attempt to offset the undesirable lateral forces, a variety of stabilizers have been employed. Roller stabilizers which are attached to the base plate of the raise head have been used as described in U.S. Pat. No. 3,797,592 issued to Goodfellow. It is known to mill the raise boring bit body stems in either hexagonal or octagonal shapes. The stem with hard faced ribs thus serves as a rotating stabilizer during the pilot hole enlargement cycle. It is also known to provide roller stabilizers on th drill string. U.S. Pat. No. 3,659,660 describes the use of roller stabilizers spaced around a drill stem between two stages of roller cutter elements of different diameters.

Nevertheless, large hole size roller or rotating stabilizers have not provided adequate stabilization due to several deficiencies. First, the rollers have a tendency to fall into fissures in the rock wall. Secondly, such stabilizers are expensive to manufacture. Thirdly, they provide poor performance in out-of-round holes and finally the rapid rotation of the stabilizer rollers causes the bearings and surfaces in contact with the hole wall to quickly wear out.

Non-rotating stabilizers have been used in large diameter hole drilling operations other than raise boring operations. These non-rotating stabilizers, however, have not been mounted to the cutter assembly. Since the cross-sectional width of the stabilizer is approximately equal to the diameter of the bored hole, these non-rotating stabilizers are prone to excessive wear and can easily become jammed within the hole as the drill bit body is withdrawn after the hole is completed.

The above difficulties have created a significant need for an efficient and less expensive means for stabilizing raise bore bit assemblies, and especially in situations of drilling large diameter holes at angles.

SUMMARY OF THE INVENTION

The problems encountered in the past have been obviated by the present invention which comprises a drill bit body or boring raise head to which is attached a non-rotating stabilizer of substantially equal diameter having a radially outer portion which contacts the walls of the bored holes, and a radially inner portion which is able to rotate with respect to the outer portion. The stabilizer is positioned below the raise head so that it follows the raise head as the pilot hole is enlarged.

In a preferred embodiment of the invention, a second raise boring head having a larger diameter than the first raise head is connected to the stabilizer such that the stabilizer is positioned between the two drill bit bodies.

The outer portion of the stabilizer comprises a plurality of radially extending pads which contact the walls of the bored hole and are circumferentially spaced around the inner portion of the stabilizer. The radial length of the pads can be adjusted by the addition or removal of shims. The inner portion of the stabilizer comprises a mandrel whose axis of rotation is that of the raise heads. The inner and outer portions of the stabilizer are rotationally connected by means of rolling element bearings.

In a preferred structural embodiment, the radially extending pads each form a box-like structure having an inner wall which cooperates with the bearings of the rotatable connection, two vertically oriented radially extending side walls which connect the inner wall with a shoe that contacts the walls of the hole, and an upper wall which connects an upper portion of the inner wall and side walls with an upper portion of the shoe. This box-like structure provides strength and stability while minimizing construction cost. Each shoe is provided with a large surface area which maximizes the contact of the shoes with the walls of the hole. Preferably, the shoes have inwardly extending flanges on their upper and lower ends so that the shoes are sled-like structures which minimize the possibility of the stabilizer becoming jammed within the hole and maximize the contact of the stabilizer with the walls of the bored hole to facilitate stabilization.

The invention with its advantageous positioning of the stabilizer between the raise heads provides excellent stabilization for the drilling assembly. It possesses the tremendous advantage that as the heads are lowered down the hole on completion of the raise, the stabilizer cannot become jammed because it is smaller in diameter than the finished size of the hole. This invention also significantly expands the operating envelope for raise boring. Thus, it is possible to bore holes 10 feet in diameter at an angle of approximately 60° from horizontal in hard rock with a single pass using the present invention. This means that raise boring can now be used where a combination of hole diameter, angle and rock type have heretofore made it impractical.

The above advantages will become more apparent from a consideration of the following detailed description when taken in conjunction with the accompanying drawings.

DETAILED DESCRIPTION OF THE PREFERRED EMBODIMENT

Figure 1:
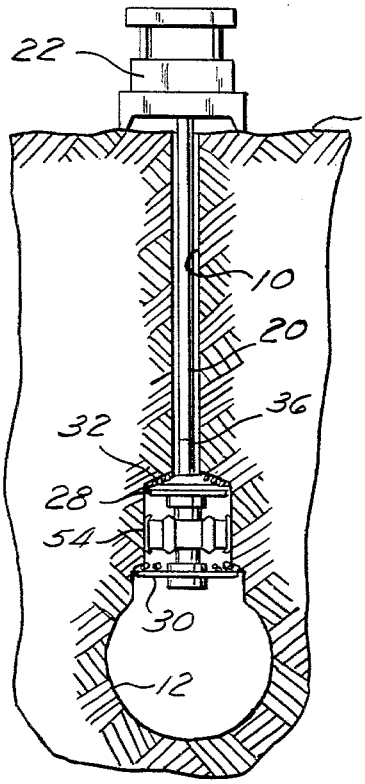
FIG. 1 is a schematic view of a raise drilling operation.

Referring to FIG. 1, a typical raise drilling operation is shown in which a pilot hole 10 extends from an underground tunnel 12 upwards to ground level 14. The pilot hole 10 is being enlarged by a drill bit body or raise boring head 28 having a drill stem 36 which is connected to the drill string 20 as is wellknown in the art. The drill string 20 is, in turn, connected to a drill rig 22 which provides the needed force to pull the raise head 28 upward to the ground level 14. Mounted on the raise head 28 are frustoconical cutters shown generally at 32 which are directed toward the drill rig 22 so that as the raise head 28 is pulled by the drill rig 22, the pilot hole 10 is enlarged in diameter. A raise drilling operation also commonly occurs when the upper level is below the ground as well as the lower level, such as in a mine.

Figure 2:
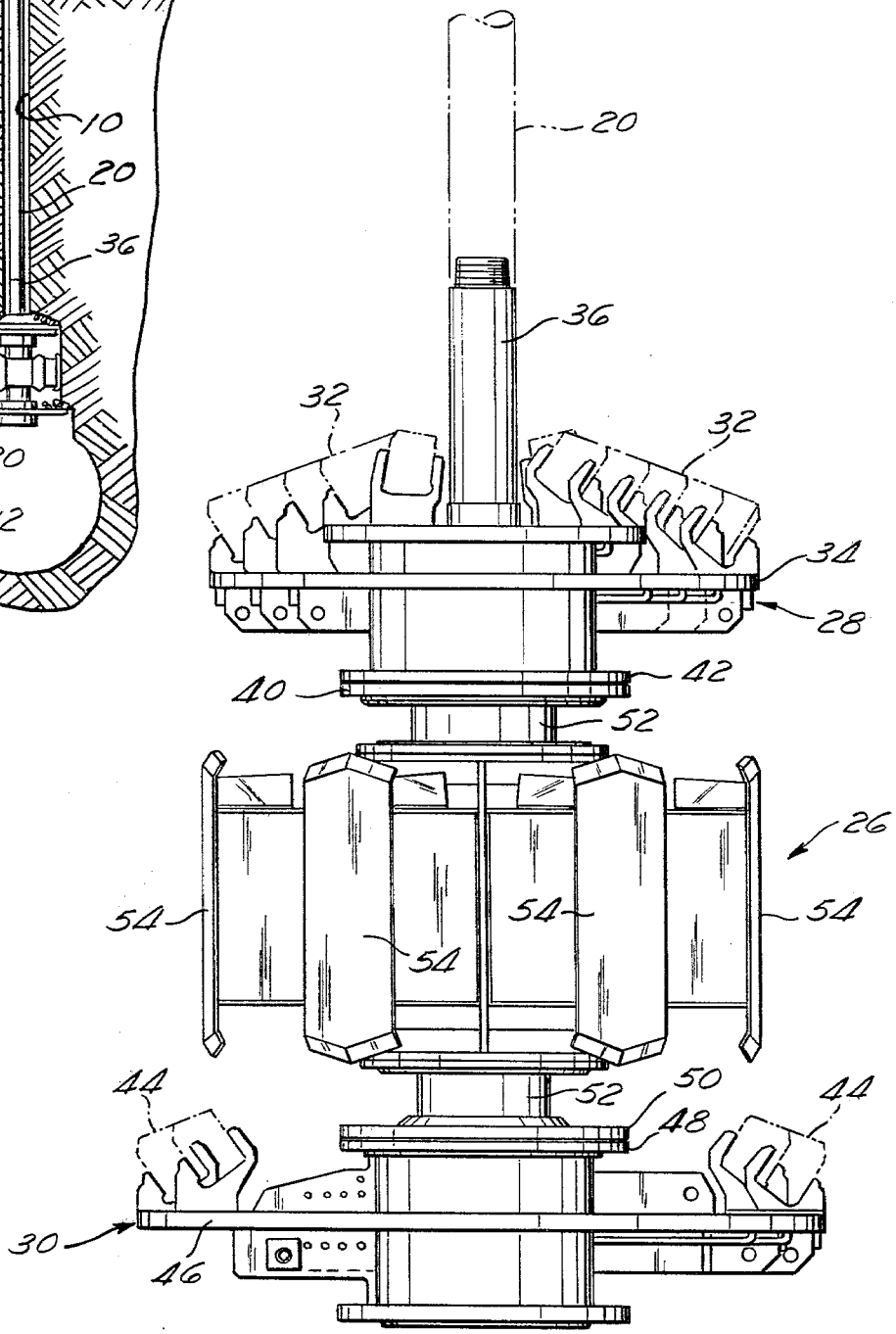
FIG. 2 is a preferred embodiment of the invention showing a pair of raise heads with the non-rotating stabilizer positioned between them.

Referring now to FIG. 2, the stabilizer invention is shown generally at 26 positioned between the smaller diameter raise head 28 and the large diameter raise head 30. The raise heads 28 and 30 are known items to those of ordinary skill in the art. As shown, raise head 28 has a diameter of 8 feet and contains a plurality of cutters 32 which extend upwardly and are rotatably mounted on its front side or base plate 34. In the example shown, the stabilizer 26 has a cross-sectional width or diameter which is approximately equal to the 8 foot diameter of the raise head 28. The stabilizer 26 has an upper plate 40 which is bolted to a back side or lower plate 42 of the raise head 28. The stabilizer 26 may be used in conjunction with a single raise head or as shown in FIG. 2 in the preferred embodiment, a second raise head 30 which is of larger diameter than raise head 28 as shown attached to the stabilizer 26.

The raise head 30 has a diameter of 10 feet, and has frusto-conical cutters 44 mounted on a base plate 46 in a similar manner to that of raise head 28. Raise head 30 has an upper plate 48 which is bolted to a lower plate 50 of the stabilizer 26.

The stabilizer 26 has a radially inner portion which comprises a mandrel 52 and a radially outer portion which comprises a plurality of radially extending pads 54 that contact the walls of the bored hole. Although the stabilizer is referred to as non-rotating, the term "non-rotating" as used in this specification means a stabilizer in which the inner portion is able to rotate with respect to the outer portion when the pads of the outer portion contact the hole.

Figure 3:
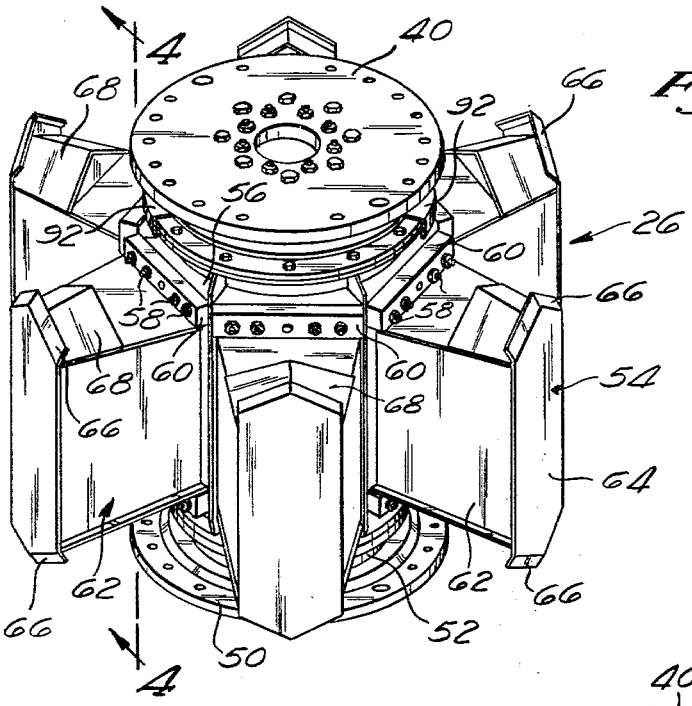
FIG. 3 is a perspective view of the non-rotating stabilizer of FIG. 2 with the raise heads removed.

Referring now to FIG. 3, a perspective view of the inventive stabilizer 26 is shown with the raise heads 28 and 30 removed. The stabilizer 26 has a cylindrical rotating mandrel 52 which extends vertically between the upper plate 40 and lower plate 50. The axis of rotation of the mandrel 52 is the same as the axis of rotation of the raise heads 28 and 30. As shown in the preferred embodiment, there are six pads 54 which extend radially outward from a non-rotating housing 56 at approximately equally spaced 60° intervals. Each of the pads 54 is bolted to the housing 56 by means of a plurality of bolts 58 which extend through rectangular blocks 60 located directly above and below each of the pads 54.

The pads 54 have truncated wedge-shaped arm sections 62 which are capped by large outwardly facing shoes 64 that contact the sides of the bored hole. The shoes 64 are preferably curved on the outer surface to conform closely to the walls of the round bored hole. Shoes 64 have large surface areas for contacting the walls of the hole. Preferably, the vertical length of the shoes, i.e. running parallel to the axis of rotation, is substantially greater than their circumferential width. At the upper and lower ends of the shoes 64, are flanges 66 which are turned inward toward the center of the stabilizer 26. These flanges 66 allow the pads 54 to travel more easily along the sides of the bored hole, thus minimizing the possibility of jamming of the stabilizer 26. Adjacent to and radially inward from each of the shoes 64 are peaked portions 68 which are attached to the top of each of the arms 62. The peak of the portion 68 is directed upward so that rock and debris which are produced from the boring of the hole will be deflected from the top of the arm 62. The peaked portion 68 thus prevents a buildup of heavy material upon the pads 54.

Figure 4:
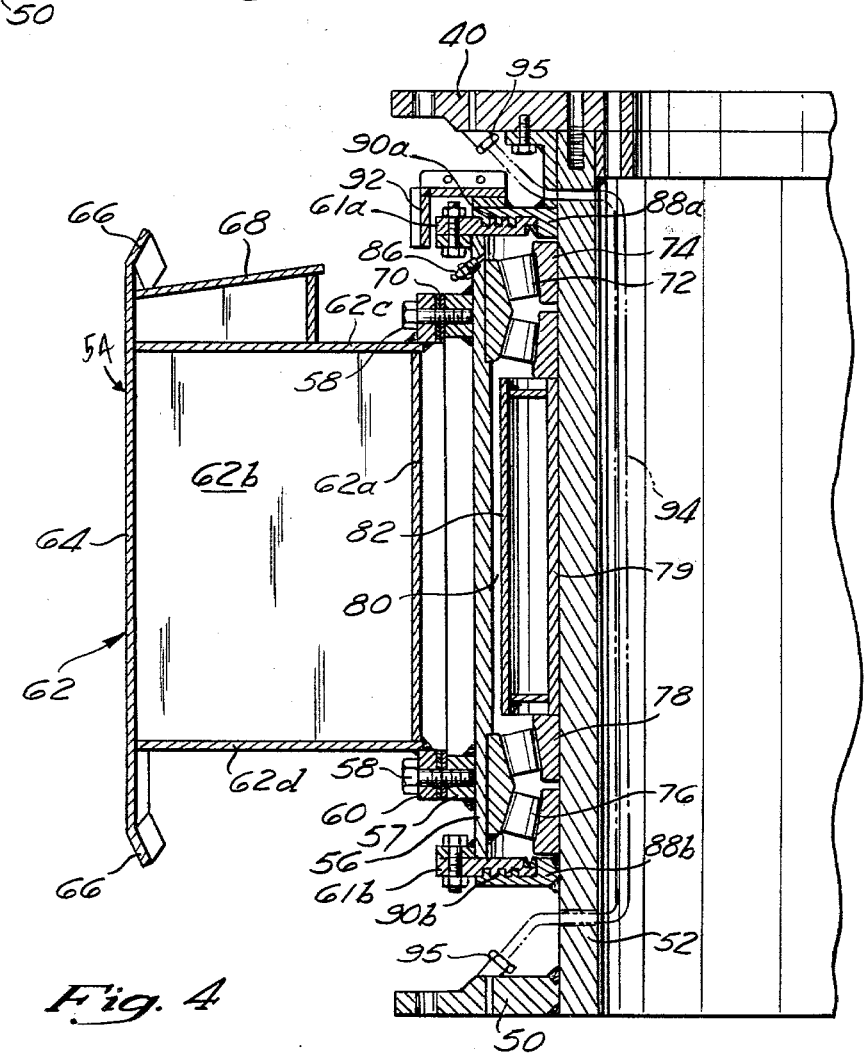
FIG. 4 is a cross-sectional view taken along lines 4—4 of FIG. 3 showing the details of the structure.

Referring now to FIG. 4, there is shown a cross-sectional view of one side of the stabilizer 26 taken along the lines 4—4 of FIG. 3. One of the pads 54 is shown bolted to tapped holes in mounting members 57 which are welded to the stabilizer housing 56. The bolts extend through the upper and lower rectangular blocks 60 welded to the arm 62. The stabilizer's diameter can be adjusted through the addition or removal of shims 70 between the mounting members 57 and the upper and lower rectangular blocks 60. Thus, minor variations in hole size can be accommodated through minor adjustments in the radial length of the pad 54. As can more clearly be seen in FIG. 4, the arm 62 is a hollow box-like structure which includes a vertical inner wall **62*a*, a pair of vertically oriented and radially extending side walls 62*b*, upper and lower horizontal walls 62*c* and 62*d* and an outer vertical wall formed by the shoe 64**. This box-like structure minimizes the amount of material needed to construct the arms and yet the arms have excellent structural strength.

The central rotating mandrel 52 is rotatably joined to the non-rotating housing 56 and pads 54 by means of two pair of upper and lower rings of roller bearing elements. In FIG. 4, the upper rings of roller bearing elements in cross-section are shown as an upper pair of roller bearing elements 72. The upper rings of roller bearing elements are mounted between inner and outer roller races 74 captured between the housing 56 and the mandrel 52. In like manner, a lower pair of roller bearing elements 76 which form a portion of the pair of lower rings of roller bearing elements are shown. These lower roller bearing elements 76 are shown mounted in lower roller races 78. The upper and lower rings of roller bearing elements are spaced by a spacer element 79 engaging the inner bearing races. This creates an annular cavity 80 between the bearings. Grease fittings 86 located adjacent the bearing permit grease to be injected to provide lubrication for the roller bearing elements. The volume of the cavity 80 is reduced by means of a spacer box 82 attached to the element 79, which reduces the amount of grease needed.

The rotating portion of the stabilizer 26 has a circular upper flange 88*a* having ribs which mate with similar ribs on an upper circular ring 61*a* attached to a flange on the upper end of the housing 56 to form an upper labyrinth seal 90*a*. In a like manner, there is a circular lower flange 88*b* which mates with a lower circular ring 61*b* to form a lower labyrinth seal 90*b*. The circular labyrinth seals 90*a* and 90*b* protect the pairs of upper and lower rings of roller bearing elements from the dirt and fluid of the environment which is produced from boring the hole, but do not interfere with rotation of the mandrel 52. To increase the protection for the upper bearing, there is provided a circular upper shield 92 which appears L-shaped in cross-section, and which makes it even more difficult for fluid or earth material to contact the pair of upper rings of roller bearing elements.

As described above, the stabilizer 26 is preferably positioned between two raise heads. A fluid spray system is often provided on the raise heads for cleaning of cutters and removing disintegrated rock chips and earth material. In order to convey the fluid from the upper raise head 28 to the lower raise head 30, there is provided a flexible hose 94. The hose 94 extends from a fitting 95 in the stabilizer upper plate 40 through a hole in the mandrel, along the inside of the mandrel 52, out a hole in the mandrel and then connects to a fitting 95 in the stabilizer lower plate 50. In operation the fittings are connected to other portions (not shown) of the fluid circulating system in the raise heads.

In operation, the stabilizer pads 54 engaging the walls of the bored hole, of course, do not rotate, while the inner mandrel 52 rotates with the raise heads 28 and 30. When the drill rig pulls upward on the drill string, the cutters 32 of the raise head 28 bore an 8 foot diameter hole. The stabilizer 26 which is approximately equal in diameter to the raised head 28, follows the raise head 28 up the bored hole. The raise head 30 follows the stabilizer 26 and bores a larger ten foot diameter hole. The position of the stabilizer 26 between the raise heads 28 and 30 provides excellent stabilization to both raise heads since it is advantageously positioned between them. When the raise heads are lowered down the hole on completion of the raise, the stabilizer will not become jammed since it is smaller in diameter than the finished size of the hole. The invention provides sufficient stabilization so that the operating envelope of raise boring is significantly expanded. It has been found that raise boring holes of ten feet can be successfully made at an angle of 60° from horizontal in hard rock with a single pass. Since the pads of the stabilizer do not rotate, they wear exceptionally well and do not need to be replaced nearly as often as roller stabilizers.

What is claimed is:

1. An earth boring drilling assembly for drilling large diameter holes having a rotatable drill string comprising:

(a) a first drill bit body which is connected to rotate with said drill string;

(b) a stabilizer having a radially inner portion connected to rotate with said first drill bit body and an outer portion rotatably mounted on said inner portion, said outer portion comprising a plurality of radially extending pads circumferentially spaced around said inner portion each pad forming a box-like structure comprising:

(i) an inner vertically oriented wall;

(ii) a pair of spaced vertically oriented side walls extending radially outward from said inner wall;

(iii) an outer wall connected to said side walls forming a vertically extending shoe which engages the wall of the hole being drilled; and (iiii) an upper wall which connects the upper ends of said inner wall, said side walls and said shoe to form said box-like structure.

2. The earth boring drilling assembly of claim 1 additionally comprising a second drill bit body connected to said stabilizer so that said stabilizer is positioned between said first and second drill bit bodies, said second drill bit body having a diameter larger than said stabilizer and said first drill bit body.

3. A raise earth boring assembly which is pulled upward from one level to another level and which enlarges a small diameter hole into a larger diameter hole comprising:

(a) a rotating drill string;

(b) a raise head having front and back sides, said front side being connected to said drill string and serving as a mount for upwardly directed cutters;

(c) a stabilizer positioned below the back side of said raise head so that said stabilizer follows the raise head as it bores the hole, said stabilizer having radially outer and inner portions, said outer portion having means for engaging the walls of the hole, said inner portion being able to rotate with respect to said outer portion when said engaging means engages the walls of the hole, said hole engaging means comprising a plurality of radially extending pads circumferentially spaced around said inner portion, said outer portion having means for mounting said pads; and (d) shims for adjusting the radial length of said pad mounting means.

4. An earth boring drilling assembly for drilling large diameter holes comprising:

(a) a first drill bit body;

(b) a second drill bit body having a larger diameter than said first drill bit body;

(c) a stabilizer substantially equal in diameter to said first drill bit body and positioned between said first and second drill bit bodies, said stabilizer having radially outer and inner portions, said outer portion having means for engaging the walls of the hole, said inner portion being able to rotate with respect to said outer portion when said engaging means engages the walls of the hole, said stabilizer having tube means extending between said first and second drill bit bodies for conveying fluid.

5. An earth boring drilling assembly for drilling large diameter holes comprising:

(a) a first drill bit body;

(b) a second drill bit body having a larger diameter than said first drill bit body;

(c) a stabilizer substantially equal in diameter to said first drill bit body and positioned between said first and second drill bit bodies, said stabilizer having radially outer and inner portions, said outer portion having means for engaging the walls of the hole, said inner portion being able to rotate with respect to said outer portion, said outer portion comprising a structural housing to which said inner portion is rotatably connected and upon which said hole engaging means is mounted, said hole engaging means extending radially outward from said housing to contact the hole; and (d) shim means positioned between said housing and said hole engaging means for adjusting the radial length of said hole engaging means.

6. An earth boring drilling assembly for drilling large diameter holes comprising:

(a) a first drill bit body;

(b) a second drill bit body having a larger diameter than said first drill bit body;

(c) a stabilizer substantially equal in diameter to said first drill bit body and positioned between said first and second drill bit bodies, said stabilizer having radially outer and inner portions, said outer portion having means for engaging the walls of the hole, said inner portion being able to rotate with respect to said outer portion, said outer portion comprising a structural housing to which said inner portion is rotatably connected and upon which said hole engaging means is mounted, said hole engaging means extending radially outward from said housing to contact the hole, said hole engaging means comprising a plurality of radially extending pads circumferentially spaced around said inner portion.

* * * * *